US009332857B2

(12) United States Patent
Alzoubi et al.

(10) Patent No.: US 9,332,857 B2
(45) Date of Patent: May 10, 2016

(54) MATTRESS ASSEMBLY

(71) Applicants: Mohamed F. Alzoubi, Orland Park, IL (US); Tyler Wayne Kilgore, Kingsport, TN (US); Christopher Arendoski, Gross Pointe Farms, MI (US)

(72) Inventors: Mohamed F. Alzoubi, Orland Park, IL (US); Tyler Wayne Kilgore, Kingsport, TN (US); Christopher Arendoski, Gross Pointe Farms, MI (US)

(73) Assignee: Tempur-Pedic Management, LLC, Lexington, KY (US)

( * ) Notice: Subject to any disclaimer, the term of this patent is extended or adjusted under 35 U.S.C. 154(b) by 0 days.

(21) Appl. No.: 14/102,633

(22) Filed: Dec. 11, 2013

(65) Prior Publication Data

US 2015/0157136 A1 Jun. 11, 2015

(51) Int. Cl.

| | |
|---|---|
| ***A47C 23/04*** | (2006.01) |
| ***A47C 27/20*** | (2006.01) |
| ***A47C 27/15*** | (2006.01) |

(52) U.S. Cl.

CPC ..... *A47C 27/20* (2013.01); *A47C 27/15* (2013.01)

(58) Field of Classification Search

CPC ..... A47C 27/15; A47C 27/20
USPC ..... 5/718
See application file for complete search history.

(56) References Cited

U.S. PATENT DOCUMENTS

| | | | | |
|---|---|---|---|---|
| 3,099,021 | A * | 7/1963 | Wetzler | 5/718 |
| 3,325,834 | A * | 6/1967 | Lovette et al. | 267/91 |
| 3,401,411 | A * | 9/1968 | Morrison | 5/655.8 |
| 3,769,643 | A * | 11/1973 | Adler | A47C 21/06 5/401 |
| 4,429,427 | A * | 2/1984 | Sklar | 5/654.1 |
| 5,327,596 | A * | 7/1994 | Wallace et al. | 5/655.7 |
| 5,937,464 | A * | 8/1999 | Niederman | 5/718 |
| 6,317,912 | B1 * | 11/2001 | Graebe | A47C 23/047 5/655.3 |
| 7,125,465 | B2 * | 10/2006 | Bullard | 156/182 |
| 7,337,485 | B2 * | 3/2008 | Metzger | A47C 27/081 5/682 |
| 7,496,981 | B2 | 3/2009 | Cucurull | |
| 7,805,790 | B2 * | 10/2010 | DeMoss | A47C 27/05 5/716 |
| 2004/0025258 | A1 * | 2/2004 | Van Der Wurf et al. | 5/718 |
| 2008/0083069 | A1 * | 4/2008 | Dell'Accio | 5/740 |
| 2008/0184492 | A1 * | 8/2008 | Sunde | 5/717 |
| 2011/0041252 | A1 | 2/2011 | DeFranks et al. | |
| 2012/0054968 | A1 * | 3/2012 | Hsu | A47C 23/0435 5/706 |
| 2012/0102657 | A1 | 5/2012 | Wildeman | |

FOREIGN PATENT DOCUMENTS

| | | |
|---|---|---|
| EP | 0228350 A3 | 1/1988 |

* cited by examiner

*Primary Examiner* — David E Sosnowski

(57) ABSTRACT

A mattress assembly includes a first layer of viscoelastic foam defining an upper surface, and a second layer of non-viscoelastic foam supporting the first layer. The mattress assembly also includes a plurality of spring elements positioned beneath the upper surface for enhancing a firmness of the combined first and second layers. Each of the spring elements includes a first spring having a first spring rate and a second spring having a second spring rate different than the first spring rate.

17 Claims, 9 Drawing Sheets

MATTRESS ASSEMBLY

FIELD OF THE INVENTION

The present invention relates to body support assemblies, and more particularly to mattresses and other body supports having spring elements.

BACKGROUND OF THE INVENTION

Body support assemblies are typically used in bedding, seating, and other applications to support a user's body or a portion thereof (e.g., head, shoulders, legs, etc.) while the user is at rest. With reference to mattress assemblies by way of example, many mattress assemblies include multiple foam layers. Conventional mattress assemblies are typically adapted for different firmness and comfort feel by adjusting the number, properties, and thickness of the constituent foam layers. However, due to the fact that inherent limitations exist in the design of body supports relying on these methods of firmness control, advancements in this area of technology are welcome additional to the art.

SUMMARY OF THE INVENTION

The invention provides, in one aspect, a mattress assembly including a first layer of viscoelastic foam defining an upper surface, and a second layer of non-viscoelastic foam supporting the first layer. The mattress assembly also includes a plurality of spring elements positioned beneath the upper surface for enhancing a firmness of the combined first and second layers. Each of the plurality of spring elements includes a first spring having a first spring rate and a second spring having a second spring rate different than the first spring rate.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
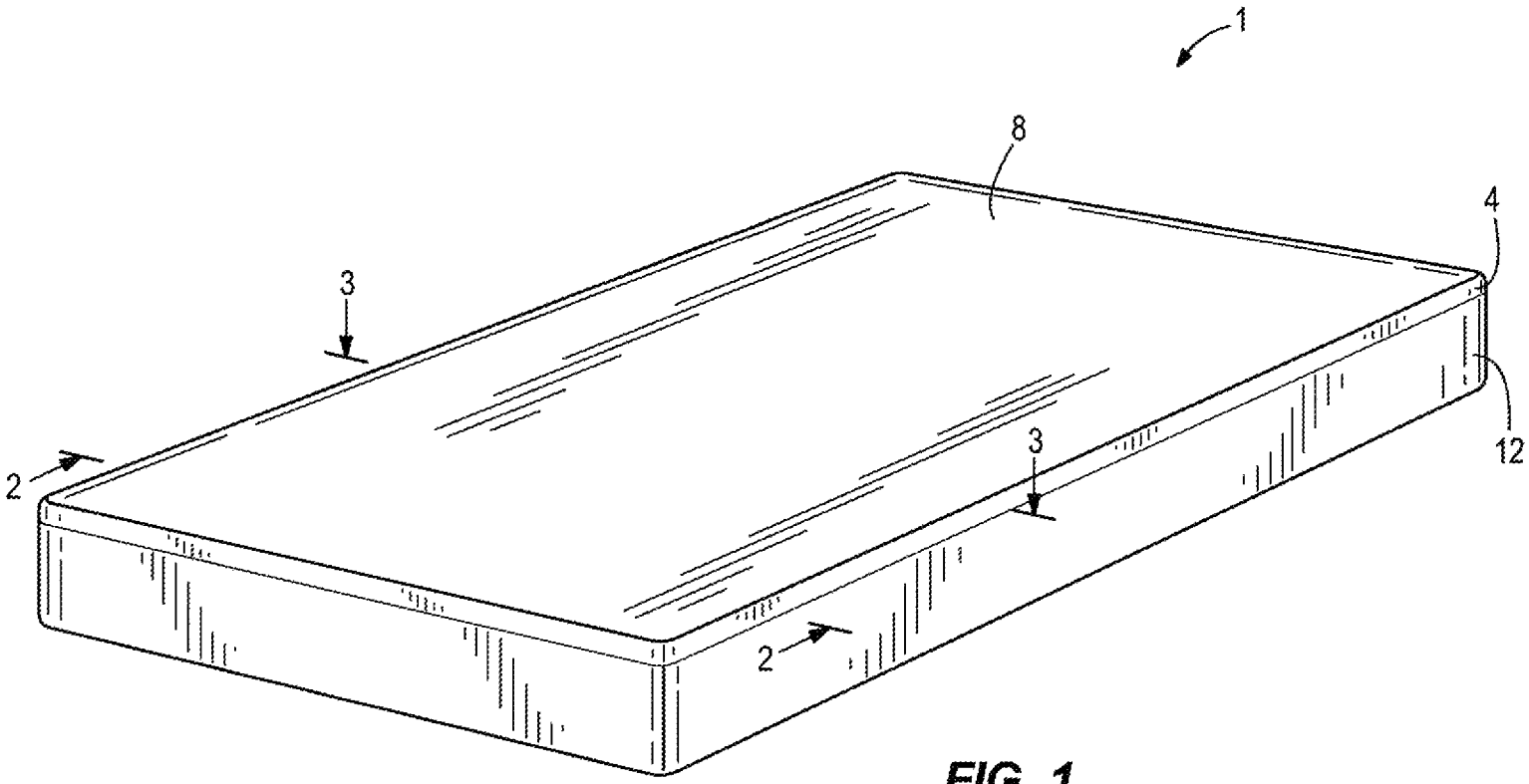
FIG. 1 is a perspective view of a mattress assembly in accordance with an embodiment of the invention.
Figure 2:
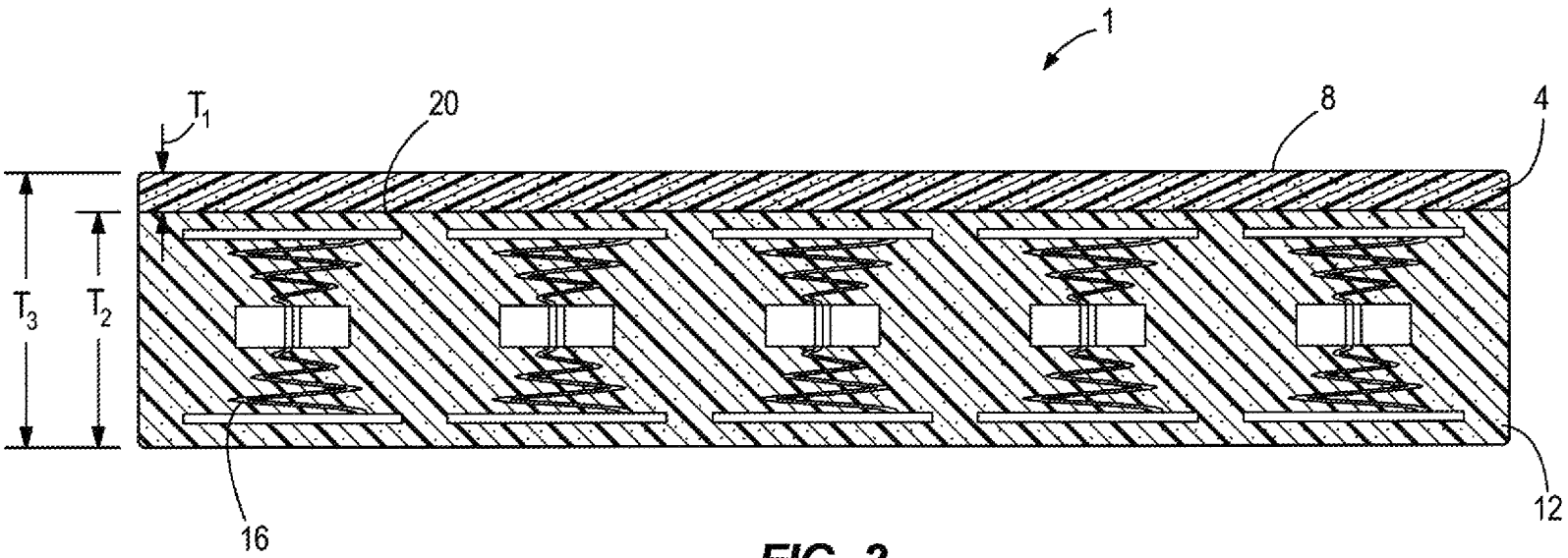
FIG. 2 is a cross-sectional view of the mattress assembly of FIG. 1, taken along line 2-2 in FIG.

FIG. 1 illustrates a mattress assembly 1 for use in a bed. The mattress assembly 1 includes a first layer 4 of viscoelastic foam defining an upper surface 8 of the mattress assembly 1 and having a thickness $T_1$ (FIG. 2). Viscoelastic foam is sometimes referred to as "memory foam" or "low resilience foam." Coupled with the slow recovery characteristic of the viscoelastic foam, the first layer 4 can at least partially conform to the user's body or body portion (hereinafter referred to as "body"), thereby distributing the force applied by the user's body upon the viscoelastic foam layer 4. The viscoelastic foam layer 4 can, provide a relatively soft and comfortable surface for the user's body. In other embodiments, the first layer 4 comprises another type of foam suitable as a mattress top layer.

In some embodiments, the viscoelastic foam layer 4 has a hardness of at least about 20 N and no greater than about 80 N for desirable softness and body-conforming qualities. Alternatively, the viscoelastic foam layer 4 may have a hardness of at least about 30 N and no greater than about 70 N. In still other alternative embodiments, the viscoelastic foam layer 4 may have a hardness of at least about 40 N and no greater than about 60 N. Unless otherwise specified, the hardness of a material referred to herein is measured by exerting pressure from a plate against a sample of the material to a compression of 40 percent of an original thickness of the material at approximately room temperature (e.g., 21 to 23 degrees Celsius). The 40 percent compression is held for a set period of time, following the International Organization of Standardization (ISO) 2439 hardness measuring standard.

With continued reference to FIG. 1, the viscoelastic foam layer 4 can also have a density providing a relatively high degree of material durability. The density of the viscoelastic foam layer 4 can impact other characteristics of the foam, such as the manner in which the viscoelastic foam layer 4 responds to pressure, and the feel of the viscoelastic foam layer 4. In the illustrated embodiment, the viscoelastic foam layer 4 has a density of no less than about 30 $kg/m^3$ and no greater than about 150 $kg/m^3$. Alternatively, the viscoelastic foam layer 4 may have a density of at least about 40 $kg/m^3$ and no greater than about 135 $kg/m^3$. In still other alternative embodiments, the viscoelastic foam layer 4 may have a density of at least about 50 $kg/m^3$ and no greater than about 120 $kg/m^3$.

The viscoelastic foam layer 4 can be made from non-reticulated or reticulated viscoelastic foam. Reticulated viscoelastic foam has characteristics that are well suited for use in the mattress assembly 1, including the enhanced ability to permit fluid movement through the reticulated viscoelastic foam, thereby providing enhanced air and/or heat movement within, through, and away from the viscoelastic foam layer 4 of the mattress assembly 1. Reticulated foam is a cellular foam structure in which the cells of the foam are essentially skeletal. In other words, the cells of the reticulated foam are each defined by multiple apertured windows surrounded by struts. The cell windows of the reticulated foam can be entirely gone (leaving only the cell struts) or substantially gone. For example, the foam may be considered "reticulated" if at least 50 percent of the windows of the cells are missing (i.e., windows having apertures therethrough, or windows that are completely missing and therefore leaving only the cell struts). Such structures can be created by destruction or other removal of cell window material, or preventing the complete formation of cell windows during the manufacturing process.

With reference to FIG. 1, the mattress assembly 1 also includes a second layer 12 of non-viscoelastic foam supporting the viscoelastic foam layer 4. The non-viscoelastic foam layer 12 has a thickness $T_2$ that is greater than the thickness $T_1$ of the viscoelastic foam layer 4. Alternatively, the thickness $T_2$ of the non-viscoelastic foam layer 12 may be the same or less than the thickness $T_1$ of the viscoelastic foam layer 4. The non-viscoelastic foam layer 12 may be a latex foam or a high-resilience (FIR) polyurethane foam, by way of example only Such a latex foam has a hardness of at least about 30 N and no greater than about 130 N for a desirable overall mattress assembly firmness and "bounce." Alternatively, the latex foam may have a hardness of at least about 40 N and no greater than about 120 N, or at least about 50 N and no greater than about 110 N. The latex foam has a density of no less than about 40 kg/m$^3$ and no greater than about 100 kg/m$^3$. In still other alternative embodiments, the latex foam may have a density of at least about 50 kg/m$^3$ and no greater than about 100 kg/m$^3$, or at least about 60 kg/m$^3$ and no greater than about 100 kg/m$^3$. In other embodiments, the second layer can comprise other types of foam as desired.

In embodiments of the mattress assembly 1 in which the non-viscoelastic foam layer 12 includes HR polyurethane foam, such a foam can include an expanded polymer (e.g., expanded ethylene vinyl acetate, polypropylene, polystyrene, or polyethylene), and the like. In some embodiments, the HR polyurethane foam has a hardness of at least about 80 N and no greater than about 200 N for a desirable overall cushion firmness and "bounce." Alternatively, the HR polyurethane foam may have a hardness of at least about 90 N and no greater than about 190 N, or at least about 100 N and no greater than about 180 N. The HR polyurethane foam has a density which provides a reasonable degree of material durability to the non-viscoelastic foam layer 12. The HR polyurethane foam can also impact other characteristics of the non-viscoelastic foam layer 12, such as the manner in which the non-viscoelastic foam layer 12 responds to pressure. In some embodiments, the HR polyurethane foam has a density of no less than about 10 kg/m$^3$ and no greater than about 80 kg/m$^3$. In still other alternative embodiments, the HR polyurethane foam may have a density of no less than about 15 kg/m$^3$ and no greater than about 70 kg/m$^3$, or no less than about 20 kg/m$^3$ and no greater than about 60 kg/m$^3$.

Figure 3:
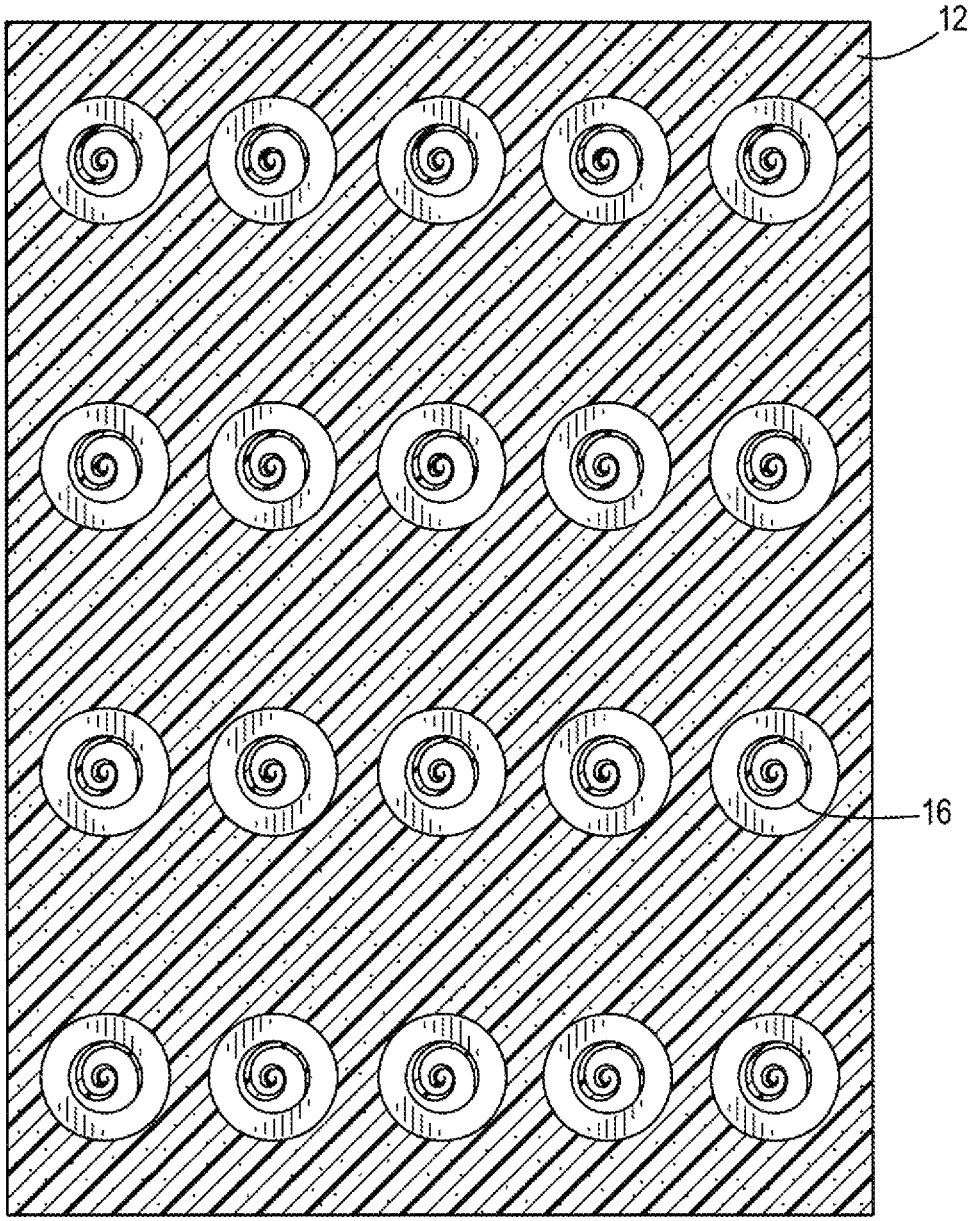
FIG. 3 is a cross-sectional view of the mattress assembly of FIG. 1, taken along line 3-3 in FIG. 1.

With reference to FIGS. 2 and 3, the mattress assembly 1 further includes multiple static spring elements 16 positioned beneath the upper surface 8 of the mattress assembly 1 for enhancing a firmness of the combined viscoelastic and non-viscoelastic foam layers 4, 12. Particularly, the spring elements 16 are embedded into the second layer (i.e., the non-viscoelastic foam layer 12, in the illustrated embodiment) using a molding process, and the viscoelastic foam layer 4 is attached to the upper surface 20 of the non-viscoelastic foam layer 12 (e.g., using adhesives, etc.). In the illustrated embodiment, the spring elements 16 are aligned with a thickness $T_3$ of the mattress assembly 1 and are entirely encased within the non-viscoelastic foam layer 12 (FIG. 2). In other words, each spring element 16 is separated or isolated from adjacent spring elements 16 by the non-viscoelastic foam layer 12. The spring elements 16 may be partially encased within the non-viscoelastic foam layer 12 and covered by the viscoelastic foam layer 4 such that the spring elements 16 may be positioned between the viscoelastic and non-viscoelastic foam layers 4, 12.

The spring elements 16 of the illustrated embodiment are arranged in an array having multiple rows and multiple columns (FIG. 3). The array can be in the form of a grid, in which the spring elements 16 are spaced across a portion or all of the width and length of the mattress assembly 1. In such cases, consecutive spring elements 16 extending in width-wise and lengthwise directions along the mattress assembly 1 can extend substantially parallel to the width and length of the mattress assembly 1. Alternatively, consecutive spring elements 16 may extend diagonally with respect to the width and length of the mattress assembly 1. In other words, each row may be offset or shifted relative to the preceding and/or following row. In still other alternative constructions, the spring elements 16 may be arranged randomly, in a single row, in a single column, in arcs, rings, concentric rings, or other geometric shapes and patterns, or in combinations thereof.

With continued reference to FIGS. 2 and 3, the spring elements 16 are made of a polymeric material, and more specifically, a thermoplastic material (e.g., TPEE, SBS, SEBS, TPV, etc.). The spring elements 16 are configured as coil springs having the same length. Alternatively, the spring elements 16 may be configured as leaf springs, for example, or any of a number of different types of springs. In still other alternative constructions, the spring elements 16 may include different lengths. For example, a first spring element 16 may have a different length than a second spring element 16 or a first group of spring elements 16 may have a different length than a second group of spring elements 16, and so forth. In the illustrated embodiment of the mattress assembly 1, the spring elements 16 have the same spring rates. Alternatively, the spring elements 16 may have different spring rates. For example, a first spring element 16 may have a different spring rate than, a second spring element 16 or a first group of spring elements 16 (e.g., located in a first region of the mattress assembly 1, such as a torso region of the mattress assembly) may have a different spring rate than a second group of spring elements 16 (e.g., located in a second region of the mattress assembly 1, such as a buttocks and/or legs region of the mattress assembly), and so forth.

The spring rate of the spring elements 16 can be a constant spring rate or a variable spring rate. Spring elements 16 including a constant spring rate often have the same or a constant spacing between coils of the spring element 16 as compared to a variable spring rate, in which the spacing between the coils is often different or variable.

In some embodiments of the mattress assembly 1, the firmness of the combined viscoelastic and non-viscoelastic foam layers 4, 12 can be enhanced substantially uniformly across the width and length of the mattress assembly 1. Alternatively, the firmness of the combined viscoelastic and non-viscoelastic foam layers 4, 12 can be enhanced non-uniformly across the width and length of the mattress assembly 1. For example, the non-uniform firmness of the mattress assembly 1 may be tuned (e.g., by using different spring elements, different rate spring elements, a combination of constant and variable rate spring elements, etc.) in accordance with the locations or regions of the mattress assembly 1 normally associated with certain portions (e.g., head, shoulders, legs, etc.) of the user's body that require different support. In other words, the spring elements 16 may be selected to enhance the firmness of the combined viscoelastic and non-viscoelastic foam layers 4, 12 a greater amount in regions of the mattress assembly 1 associated with a reclined user's lower legs, posterior, and head/neck, for example.

With continued reference to FIGS. 2 and 3, the spring elements 16 have the same material thickness (i.e., the thickness of the material shaped into the spring elements 16 show by way of example in the illustrated embodiment), winding density, shape, and diameter. However, in alternative embodiments of the mattress assembly 1, the material thickness, winding density, shape, diameter, or combinations thereof may be altered to more or less enhance the firmness of the combined viscoelastic and non-viscoelastic foam layers 4, 12.

When using the mattress assembly 1, the user's body contacts the upper surface 8 of the mattress assembly 1. In turn, the spring elements 16 enhance the firmness of the combined viscoelastic and non-viscoelastic foam layers 4, 12 to provide comfort to the user. By replacing a portion of the non-viscoelastic foam layer 12 with the spring elements 16, the mattress assembly 1 can have a lower weight as compared to conventional mattress assemblies, and can provide a firmness and pressure responsiveness that is more desirable for particular users. Additionally, the mattress assembly 1 can be readily altered with respect to the comfort and feel provided to the user by altering the spring elements 16 to have a different spring rate, material thickness, shape, and the like. In other words, the mattress assembly 1 can be manufactured in a cost-effective manner to provide users with different mattress assemblies 1 having different properties (e.g., firmness, feel, etc.) by altering the spring elements 16 as compared to a conventional mattress assembly in which an entire layer or more would need be redesigned to provide a different mattress assembly to the user.

Figure 4:
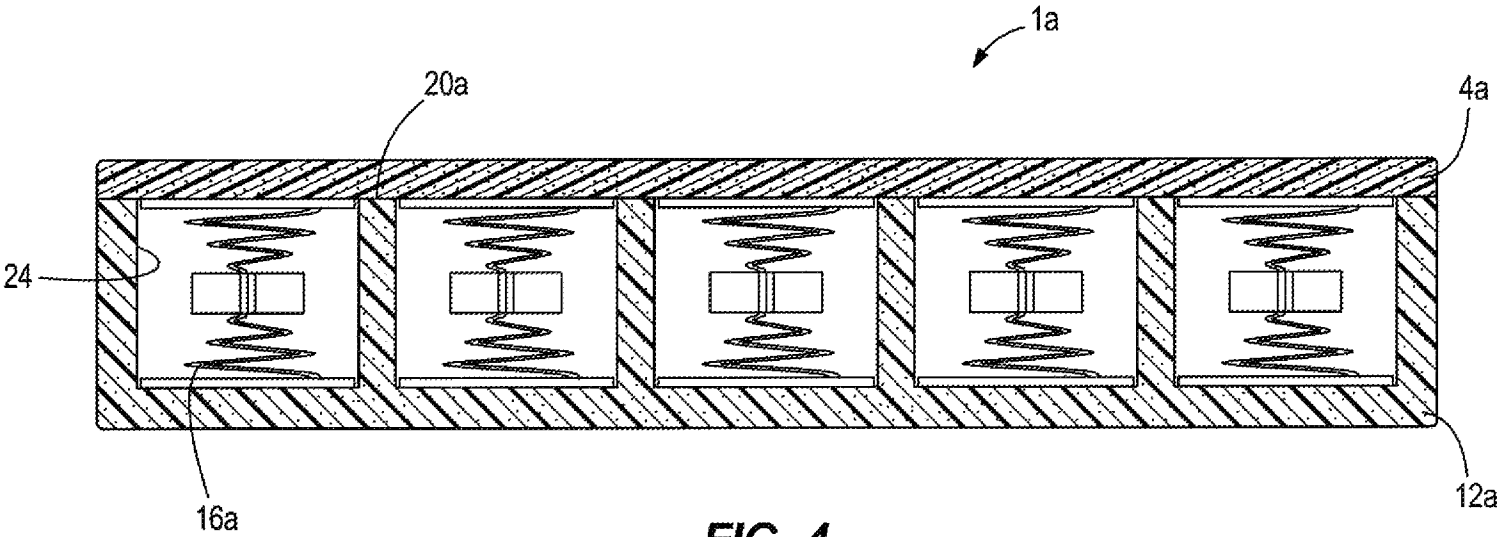
FIG. 4 is a cross-sectional view, similar to that of FIG. 2, of a mattress assembly in accordance with another embodiment of the invention.
Figure 5:
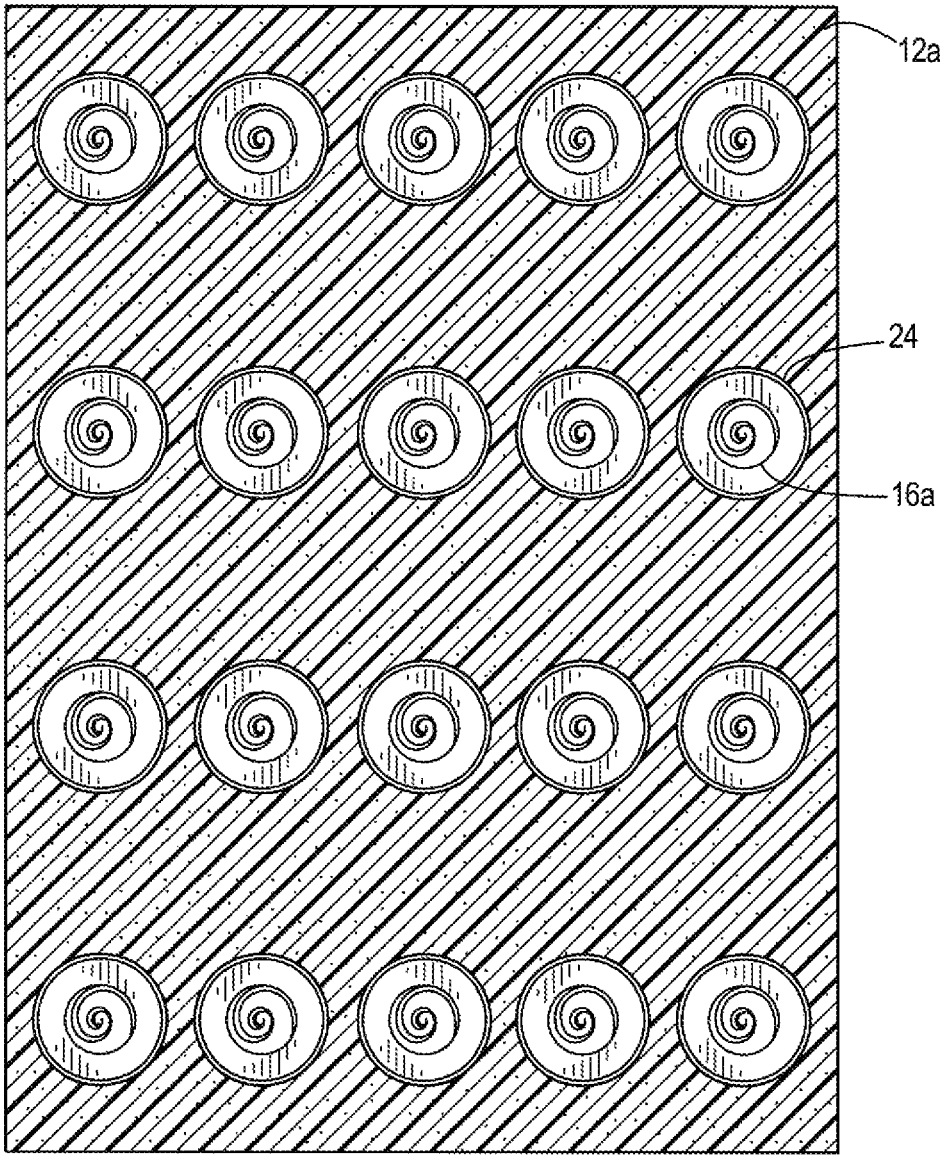
FIG. 5 is a cross-sectional view, similar to that of FIG. 3, of the mattress assembly of FIG. 4.

FIGS. 4 and 5 illustrate a second embodiment of the mattress assembly 1*a* used in connection with beds. Like components to those of the embodiments described above in connection with FIGS. 1-3 are identified with like reference numerals with the letter "a," and will not be described again in detail. Rather than embedding the spring elements 16 into the non-viscoelastic foam layer 12 as shown in FIGS. 2 and 3 and described above, the mattress assembly 1*a* illustrated in FIGS. 1-3 include spring elements 16*a* positioned within discrete cavities 24 within the non-viscoelastic foam layer 12*a*. The cavities 24 can be formed in the non-viscoelastic foam layer 12*a* by a drilling process or a cutting process, for example. The spring elements 16*a* are placed or positioned within the cavities 24, and the viscoelastic foam layer 4*a* is attached or fastened to the upper surface 20*a* of the non-viscoelastic foam layer 12*a* (e.g., using adhesives, etc.).

The mattress assembly 1*a* can be used in an identical fashion as the mattress assembly 1 shown in FIGS. 2 and 3.

Figure 6:
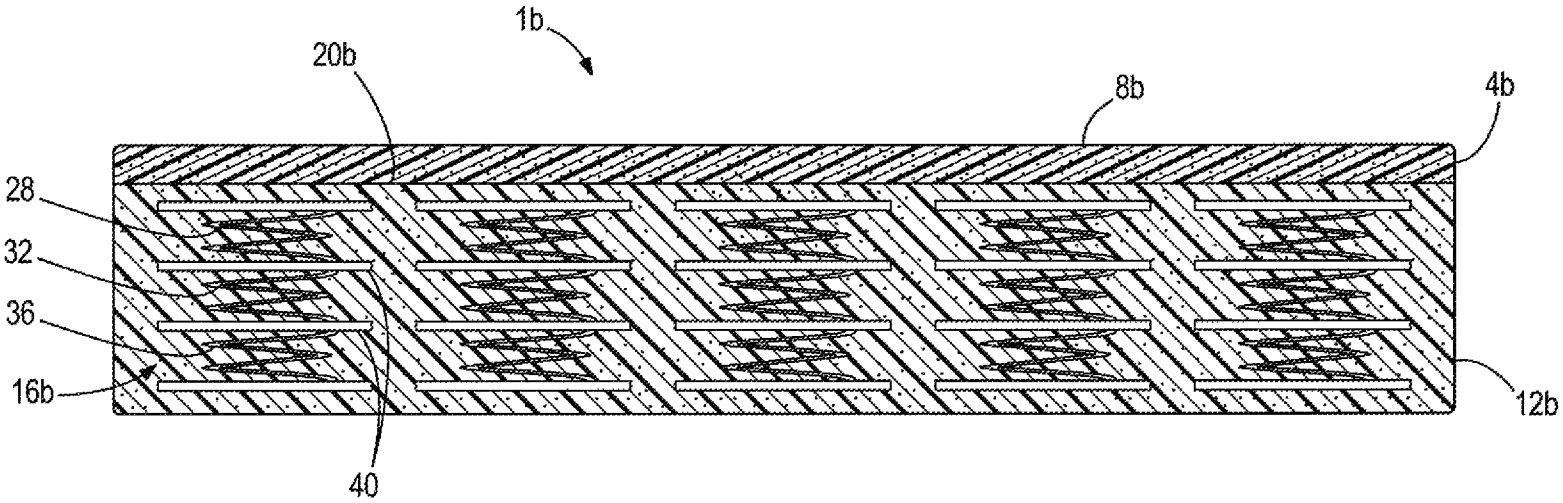
FIG. 6 is a cross-sectional view, similar to that of FIG. 2, of a mattress assembly in accordance with a further embodiment of the invention.
Figure 7:
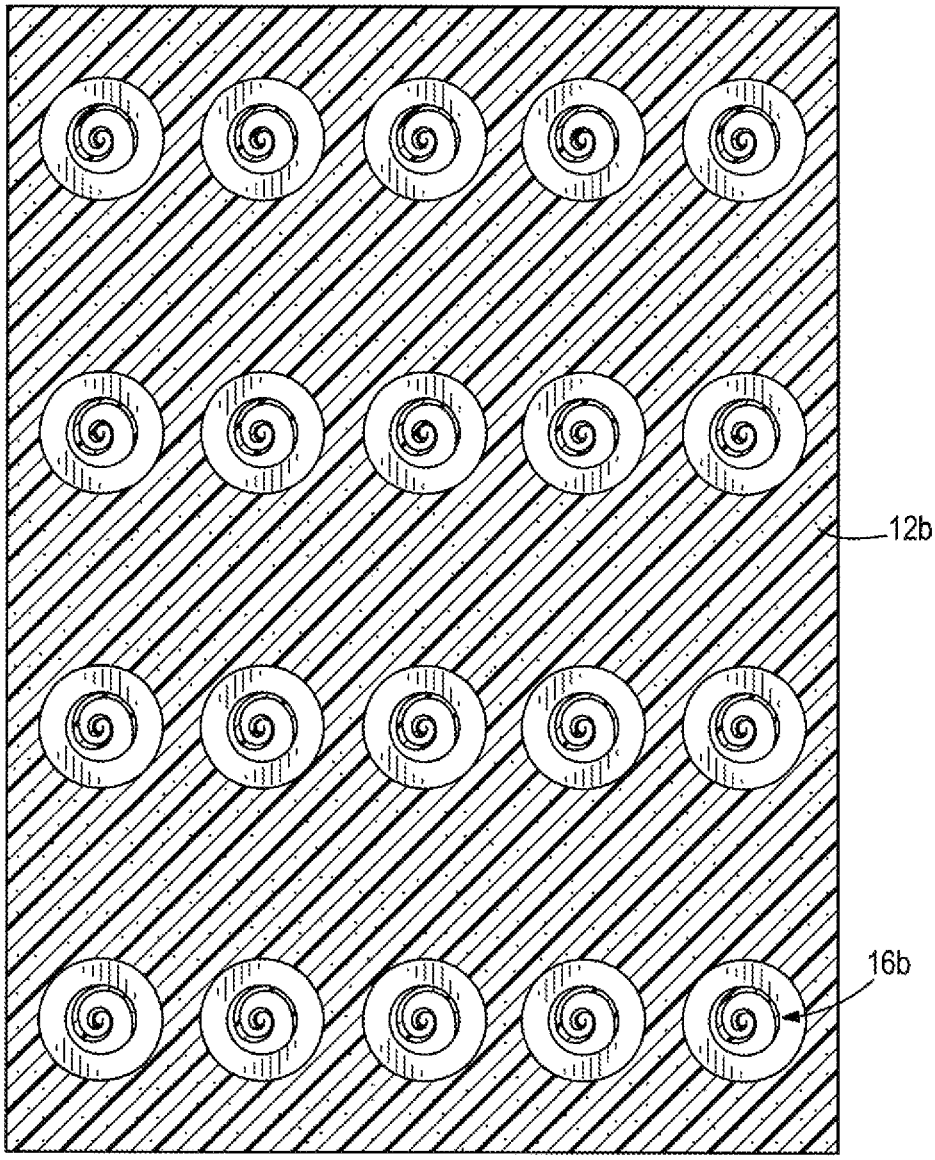
FIG. 7 is a cross-sectional view, similar to that of FIG. 3, of the mattress assembly of FIG. 6.

FIGS. 6 and 7 illustrate another embodiment of the mattress assembly 1*b* used in connection with beds. The mattress assembly 1*b* is similar to the mattress assembly 1 described above in connection with FIGS. 1-3. Like components to those of the embodiments described above in connection with FIGS. 1-3 are identified with the letter "b," and will not be described again in detail.

With reference to FIGS. 6 and 7, the mattress assembly 1*b* includes multiple static spring elements 16*b* positioned beneath the upper surface 8*b* of the mattress assembly 1*b* for enhancing a firmness of the combined viscoelastic and non-viscoelastic foam layers 4*b*, 12*b*. Particularly, the spring elements 16*b* are embedded into the non-viscoelastic foam layer 12*b* using a molding process, and the viscoelastic foam layer 4*b* is attached to the upper surface 20*b* of the non-viscoelastic foam layer 12*b* (e.g., using adhesives, etc.). The spring elements 16*b* are configured as multi-rate spring elements and include a first spring 28, a second spring 32, and a third spring 36 arranged in series (i.e., one atop the next). Alternatively, the spring elements 16*b* may include a single spring or any other number of springs (e.g., two springs, four springs, etc.) arranged in series. The first spring 28 is supported on the second spring 32, and the second spring 32 is supported on the third spring 36. The spring elements 16*b* include dividers 40 positioned between adjacent springs (i.e., between the first and second springs 28, 32, and between the second and third springs 32, 36) to facilitate and/or enhance force transfer between the springs 28, 32, 36. The dividers 40 may be formed of a polymeric material, such as non-viscoelastic foam or thermoplastic material. In some embodiments, the dividers 40 may be omitted. As a further alternative, the springs 28, 32, 36 and the dividers 40 may be integrally formed together as a single piece or may be formed as separate pieces.

Each of the springs 28, 32, 36 in the illustrated embodiment of FIGS. 6 and 7 has a different spring rate to give the mattress assembly 1*b* a different firmness or feel depending on the weight of a user's body supported by the mattress assembly 1. In the illustrated embodiment of FIGS. 6 and 7, the first spring 28 has the lowest spring rate, the second spring 32 has an intermediate spring rate, and the third spring 36 has the highest spring rate. In other words, the first spring 28 includes the lowest stiffness of the springs 28, 32, 36, while the third spring 36 includes the highest stiffness of the springs 28, 32, 36. For example, the first spring 28 can have a spring stiffness rate between 150 Ib/in and 200 Ib/in, the second spring 32 can have a spring stiffness rate between 200 Ib/in and 250 Ib/in, and the third spring 36 can have a spring rate between 250 Ib/in and 300 Ib/in. In other embodiments, the first spring 28 stands up to a maximum weight of 200 Ib human body, the second spring 32 stands up to a maximum weight of 250 Ib human body and the third spring 36 stands up to a maximum weight of 300 Ib human body. These numbers are for illustration purposes only and can be adjusted and modified by changing the stiffness spring rates for each spring 28, 32 and 36. Alternatively, the springs 28, 32, 36 can have other spring rates or relative spring rates to tune the mattress to any desired firmness or feel.

With continued reference to the illustrated embodiment of FIGS. 6 and 7, as a relatively light weight (e.g., the weight of the user's body) is applied to the mattress assembly 1*b*, the spring elements 16*b* exhibit a relatively low effective spring rate because a substantial amount of the compression of the spring element 16*b* occurs in the first spring 28 in each of the elements 16*b*. As the weight applied to the spring elements 16*b* increases (e.g., when a heavier individual is supported upon the mattress assembly 1*b*), the first springs 28 become fully compressed (or at least substantially more compressed), and the spring elements 16*b* transition to an intermediate spring rate because a substantial amount of the compression of the spring element 16 occurs in the first and second springs 28, 32 in each of the elements 16*b*. As the weight applied to the spring elements 16*b* increases further (e.g., when an even heavier individual is supported upon the mattress assembly 1*b*), the second springs 32 also become fully compressed (or at least substantially more compressed), and the spring elements 16*b* transition to their maximum effective spring rate because each of the springs 28, 32, 36 undergoes compression. Thus the spring elements 16*b* provide a variable firmness or feel depending on the weight of the user's body supported by the mattress assembly 1*b*. The springs 28, 32, 36 may be selected so that the low, intermediate, and maximum effective spring rates of the spring elements 16*b* correspond with particular weights supported by the mattress assembly 1*b*. For example, the spring elements 16*b* may exhibit the relatively low effective spring rate for a user's body weighing between about 100 lbs. and about 150 lbs. The spring elements 16*b* may exhibit the intermediate effective spring rate for a user's body weighing between about 150 lbs. and about 220 lbs. The spring elements 16*b* may exhibit the highest effective spring rate for a user's body weighing between about 220 lbs. and about 350 lbs. In other embodiments, the springs 28, 32, 36 may be selected so that the spring elements 16*b* transition between effective spring rates at other weights.

Although the springs 28, 32, 36 of the spring elements 16*b* just described are selected with spring rates that are larger with increasing depth within the mattress assembly 1*b*, this is not necessarily the case in other embodiments. The "staged" reaction of each spring 23, 32, 36 in a spring element 16*a* (i.e., one spring 23, 32, 36 of the spring 16*b* exhibiting compression at higher forces than at least one other spring element 23, 32, 36 of the spring 16*b*) can be achieved in cases where an overlying spring (e.g., spring 28) has a higher spring rate than an underlying spring (e.g., spring 32 and/or 35), in which case the underlying spring would exhibit compression before the overlying spring in a staged manner as described above. Although higher spring rates for underlying springs provide unique advantages in some embodiments, any combination of spring rates corresponding to different stacked positions of two or more springs in a spring element 16*b* is possible, and falls within the spirit and scope of the present invention.

In the illustrated embodiment, the spring rates of the respective springs 28, 32, 36 are constant. Alternatively, the spring rates of one or more of the springs 28, 32, 36 may be variable. Springs 28, 32, 36 having a constant spring rate often have the same or a constant spacing between coils as compared to a variable spring rate, in which the spacing between the coils is often different or variable.

With continued reference to FIGS. 6 and 7, each of the springs 28, 32, 36 is made of a polymeric material, and more specifically, a thermoplastic material (e.g., TPEE, SBS, SEBS, TPV, etc.). In the illustrated embodiment, the spring material is thermally conductive, and the springs 28, 32, 36 can therefore function as heat sinks to dissipate heat away from the viscoelastic foam layer 4*b* (and from the body of a user supported on the mattress assembly 1*b*). Alternatively, in other embodiments only the first spring 28 is thermally conductive, or less than all of the springs 28, 32, 36 are thermally conductive. In other alternative embodiments, the springs 28, 32, 36 may not be thermally conductive, and may not function as heat sinks.

As shown in FIG. 6, the springs 28, 32, 36 are each configured as coil springs having the same length. Alternatively, the springs 28, 32, 36 may be configured as leaf springs, for example, or any of a number of different types of springs. Alternatively, the springs 28, 32, 36 may include multiple different spring types. Accordingly, the springs of at least some spring elements 16*b* can all be of the same types of spring, or the springs of at least some spring elements 16*b* can have different spring types stacked atop one another). In still other alternative embodiments, the springs 28, 32, 36 may include different lengths. For example, a spring element 16*b* may include a first spring 28 having a different length than a second spring 32, and may include a third spring 36 having a different length than the first and second springs 28, 32. In the illustrated embodiment of the mattress assembly 1*b*, the spring elements 16*b* have the same effective spring rates (i.e., the first springs 28 have the same spring rates, the second springs 32 have the same spring rates, and the third springs 36 have the same spring rates). It will be appreciated that the spring elements 16*b* may have different spring rates. For example, a first spring element 16*b* may have a different effective spring rate than a second spring element 16*b* or a first group of spring elements 16*b* may have a different effective spring rate than a second group of spring elements 16*b*, and so forth. In such an embodiment, the first spring element 16*b* or first group of spring elements 16*b* may have first, second, and third springs 28, 32, 36 that have different respective spring rates than first, second, and third springs 28, 32, 36 of the second spring element 16*b* or second group of springs elements 16*b*, and so forth.

In some embodiments of the mattress assembly 1*b*, the firmness of the combined viscoelastic and non-viscoelastic foam layers 4*b*, 12*b* can be enhanced substantially uniformly across the width and length of the mattress assembly 1. Alternatively, the firmness of the combined viscoelastic and non-viscoelastic foam layers 4*b*, 12*b* can be enhanced non-uniformly across the width and length of the mattress assembly 1*b*. For example, the non-uniform firmness of the mattress assembly 1*b* may be tuned (e.g., by using different spring elements 16*b*, different rate springs, a combination of constant and variable rate springs, etc.) in accordance with the locations or regions of the mattress assembly 1*b* normally associated with certain portions (e.g., head, shoulders, legs, etc) of the user's body that require different support. In other words, the springs 28, 32, 36 of the spring elements 16*b* may be selected to enhance the firmness of the combined viscoelastic and non-viscoelastic foam layers 4*b*, 12*b* a greater amount in regions of the mattress assembly 1*b* associated with a reclined user's lower legs, posterior, and head/neck, for example.

When using the mattress assembly 1*b*, the user's body contacts the upper surface 8*b* of the mattress assembly 1*b*. In turn, the spring elements 16*b* enhance the firmness of the combined viscoelastic and non-viscoelastic foam layers 4*b*, 12*b* to provide comfort to the user. When supporting a relatively lightweight user, the spring elements 16*b* provide a relatively low firmness corresponding with compression of the first, softest springs 28. When supporting a heavier user, first springs 28 of some or all of the spring elements 16*b* may become fully compressed, such that the spring elements 16*b* provide increased firmness corresponding with compression of the second, intermediate springs 32. Similarly, when supporting an even heavier user, the first springs 28 and the second springs 32 may become fully compressed, such that some or all of the spring elements 16*b* provide even greater firmness corresponding with compression of the third, stiffest spring 36. Therefore, due to the multi-rate design of the spring elements 16*b*, the mattress assembly 1*b* is able to self-adjust to provide an optimum firmness as a function of the weight of the user's body.

Figure 8:
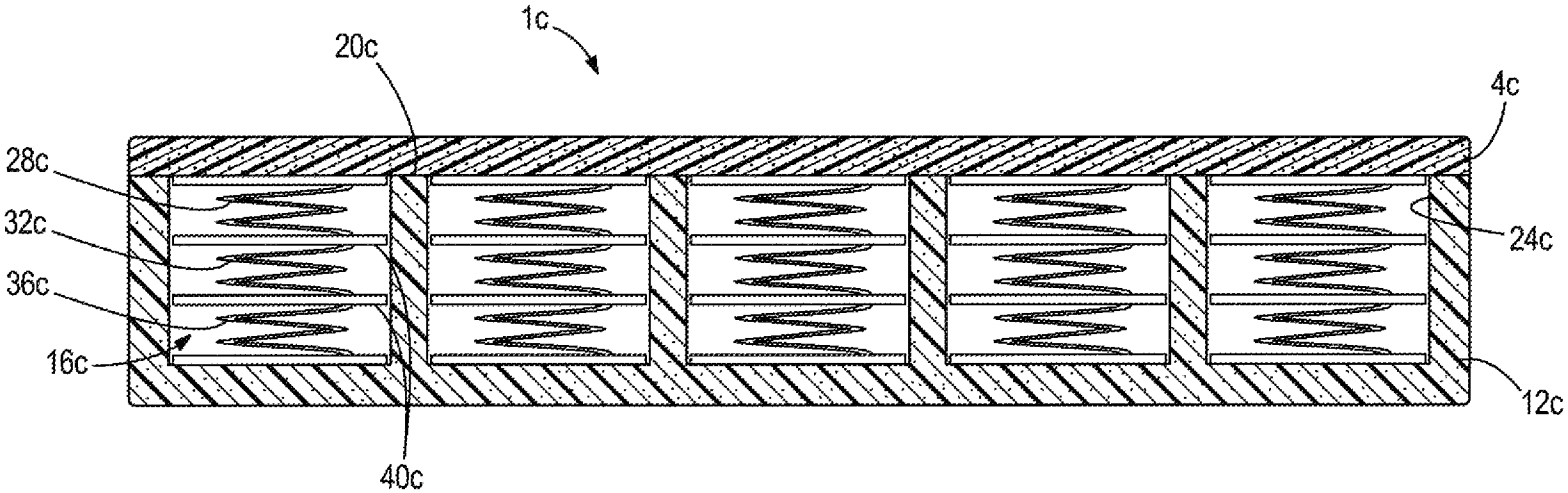
FIG. 8 is a cross-sectional view, similar to that of FIG. 2, of a mattress assembly in accordance with yet another embodiment of the invention.
Figure 9:
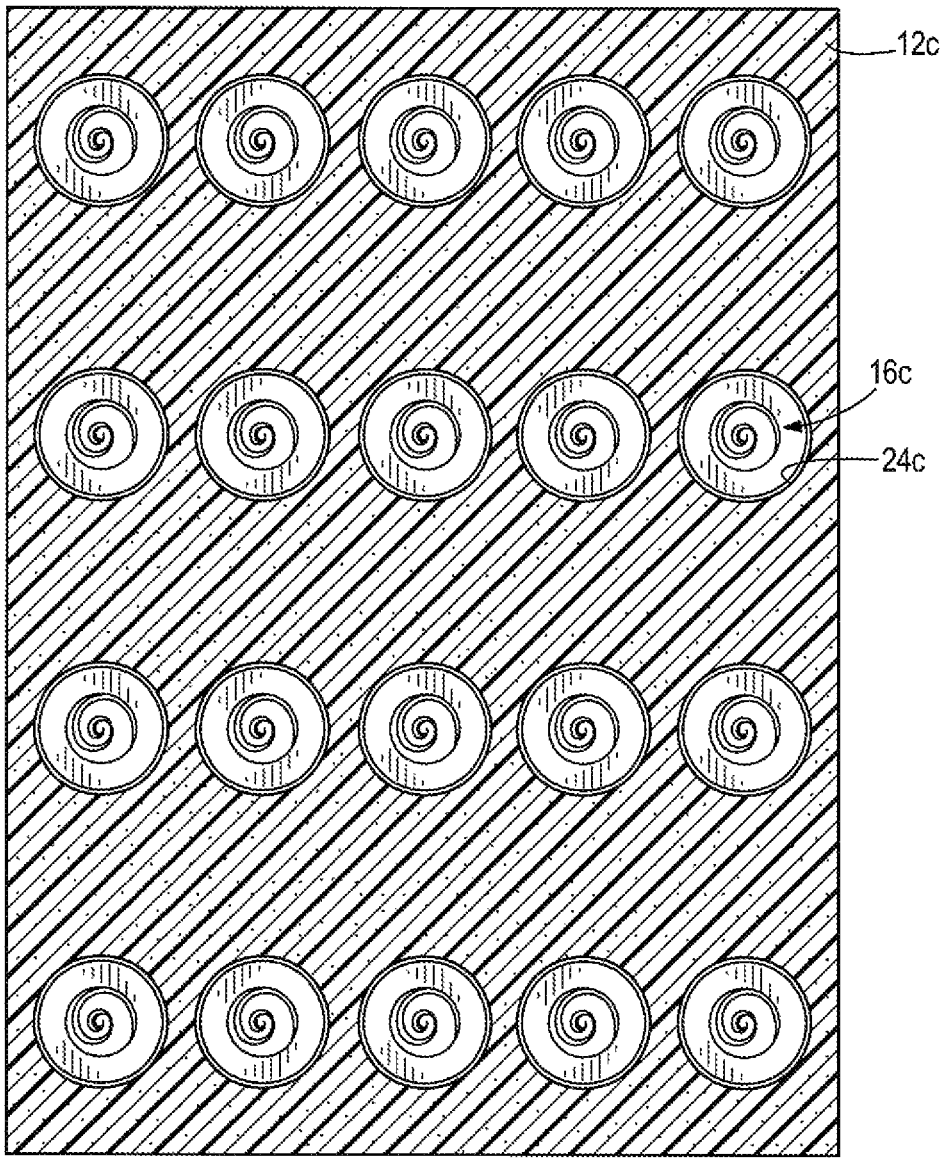
FIG. 9 is a cross-sectional view, similar to that of FIG. 3, of the mattress assembly of FIG. 8.

FIGS. 8 and 9 illustrate another embodiment of the mattress assembly 1*c* used in connection with beds. The mattress assembly 1*c* is similar to the mattress assembly 1*b* described above in connection with FIGS. 6 and 7. Like components to those of the embodiments described above in connection with FIGS. 6 and 7 are identified with like reference numerals with the letter and will not be described again in detail.

Rather than embedding the spring elements 16*c* into the non-viscoelastic foam layer 12*c* like that shown in FIGS. 6 and 7 and described above, the mattress assembly 1*c* includes spring elements 16*c* having first springs 28*c*, second springs 32*c*, and third springs 36*c* positioned in series within discrete cavities 24*c* within the non-viscoelastic foam layer 12*c*. The cavities 24*c* can be formed in the non-viscoelastic foam layer 12*c* by a drilling process or a cutting process, for example. The spring elements 16*c* are placed or positioned within the cavities 24*c*, and the viscoelastic foam layer 4*c* is attached or fastened to the upper surface 20*c* of the non-viscoelastic foam layer 12*c* (e.g., using adhesives, etc.).

The mattress assembly 1*c* is operable in an identical manner as the mattress assembly 1*b* shown in FIGS. 6 and 7 and described above.

Various features of the invention are set forth in the following claims.

What is claimed is:

1. A mattress assembly comprising:

a first layer of viscoelastic foam defining an upper surface;

a second layer of non-viscoelastic foam supporting the first layer; and a plurality of spring elements positioned beneath the upper surface for enhancing a firmness of the combined first and second layers, each of the spring elements including a first spring having a first spring rate and a second spring beneath the first spring and having a second spring rate greater than the first spring rate and a third spring beneath the second spring and having a third spring rate greater than both the first and second spring rates, wherein the first spring is supported upon the second spring and the second spring is supported upon the third spring, the spring elements being positioned in series within discrete cavities within the second layer of non-viscoelastic foam.

2. The mattress assembly of claim 1, wherein the viscoelastic foam includes a hardness of at least about 20 N and no greater than about 80 N.

3. The mattress assembly of claim 1, wherein the viscoelastic foam includes a density of no less than about 30 kg/m3 and no greater than about 150 kg/m3.

4. The mattress assembly of claim 1, wherein the second layer of non-viscoelastic foam is one of a latex foam and a high-resilience polyurethane foam.

5. The mattress assembly of claim 4, wherein the latex foam includes a hardness of at least about 30 N and no greater than about 130 N, and wherein the high-resilience polyurethane foam includes a hardness of at least about 80 N and no greater than about 200 N.

6. The mattress assembly of claim 4, wherein the latex foam includes a density of no less than about 40 kg/m3 and no greater than about 100 kg/m3, and wherein the high-resilience polyurethane foam includes a density of no less than about 10 kg/m3 and no greater than about 80 kg/m3.

7. The mattress assembly of claim 1, wherein the cavities are formed by a drilling process.

8. The mattress assembly of claim 1, wherein the cavities are formed by a cutting process.

9. The mattress assembly of claim 1, wherein the first and second springs are made of a polymeric material.

10. The mattress assembly of claim 9, wherein the first and second springs are made of a thermoplastic material.

11. The mattress assembly of claim 1, wherein the spring elements are aligned with a thickness of the mattress assembly.

12. The mattress assembly of claim 1, wherein the first and second springs are configured as coil springs.

13. The mattress assembly of claim 1, wherein the spring elements are arranged in an array having a plurality of rows and a plurality of columns.

14. The mattress assembly of claim 1, wherein the first spring rate is between about 150 lbs/in and about 200 lb/in.

15. The mattress assembly of claim 1, wherein the second spring rate is between about 200 lbs/in and about 250 lbs/in.

16. The mattress assembly of claim 1, wherein the third spring rate is between about 250 lbs/in and about 300 lbs/in.

17. The mattress assembly of claim 1, wherein at least one of the first spring and the second spring is thermally conductive to dissipate heat away from the first layer.

* * * * *